US005156722A

United States Patent [19]

Snyder et al.

[11] Patent Number: 5,156,722

[45] Date of Patent: Oct. 20, 1992

[54] DECONTAMINATION OF RADIOACTIVE METALS

[75] Inventors: Thomas S. Snyder, Oakmont; William R. Gass, Plum Boro, both of Pa.; Samuel A. Worcester, Butte, Mont.; Laura J. Ayers, Oak Ridge, Tenn.

[73] Assignee: Westinghouse Electric Corp., Pittsburgh, Pa.

[21] Appl. No.: 737,891

[22] Filed: Jul. 25, 1991

Related U.S. Application Data

[63] Continuation of Ser. No. 506,044, Apr. 9, 1990, abandoned.

[51] Int. Cl.[5] ..... C25C 1/06

[52] U.S. Cl. ..... 204/112; 423/10; 423/49

[58] Field of Search ..... 205/271; 423/10, 49; 204/112

[56] References Cited

U.S. PATENT DOCUMENTS

| | | | |
|---|---|---|---|
| 3,891,741 | 6/1975 | Carlin et al. | 204/109 |
| 4,148,631 | 4/1979 | Babjak et al. | 204/112 |
| 4,162,231 | 7/1979 | Horwitz et al. | 252/631 |
| 4,299,724 | 11/1981 | Stana | 423/10 |
| 4,395,315 | 7/1983 | Zambrano | 204/112 |
| 4,407,725 | 10/1983 | Allen et al. | 423/10 |
| 4,442,071 | 4/1984 | Lieser et al. | 423/10 |
| 4,476,099 | 10/1984 | Camp et al. | 423/10 |
| 4,656,011 | 4/1987 | Garraway et al. | 423/49 |
| 4,764,352 | 8/1988 | Bathellier et al. | 423/49 |
| 4,818,503 | 4/1989 | Nyman et al. | 423/10 |

OTHER PUBLICATIONS

Lowenheim, F., "Modern Electroplating", 3rd Edition, John Wiley & Sons, Inc., 1974, pp. 287–289.

Lowenheim, "Modern Electroplating", 3rd Edition, John Wiley & sons, Inc., 1974, pp. 40–42.

*Primary Examiner*—John Niebling
*Assistant Examiner*—Kishor Mayekar
*Attorney, Agent, or Firm*—J. C. Valentine

[57] ABSTRACT

Two alternate, mutually exclusive, methods of removing radio contaminants from metal are taught based respectively on electrowinning or electrorefining of the base metal. The alternative using electrorefining controls the anolyte oxidation potential to selectively reduce the technetium in the metallic feedstock solution from Tc(VII) to Tc(IV) forcing it to report to the anodic slimes preventing it from reporting to the cathodic metal product. This method eliminates the need for peripheral decontamination processes such as solvent extraction and/or ion exchange to remove the technetium prior to nickel electrorefining. The other alternative method combines solvent extraction with electrowinning. By oxidizing technetium to the heptavalent state and by using mixtures of tri-n-octyalphosphine oxide and di-2-ethyl phosphoric acid in aliphatic hydrocarbon carriers to extract the radio contaminants prior to electrowinning, the background metal may be recovered for beneficial reuse. Electrowinning may further polish the decontamination extraction process to remove residual actinides in solution while winning a radio- chemical free metal product. These methods are particularly useful for the decontamination of nickel by radio contaminants such as technetium and actinides.

17 Claims, 1 Drawing Sheet

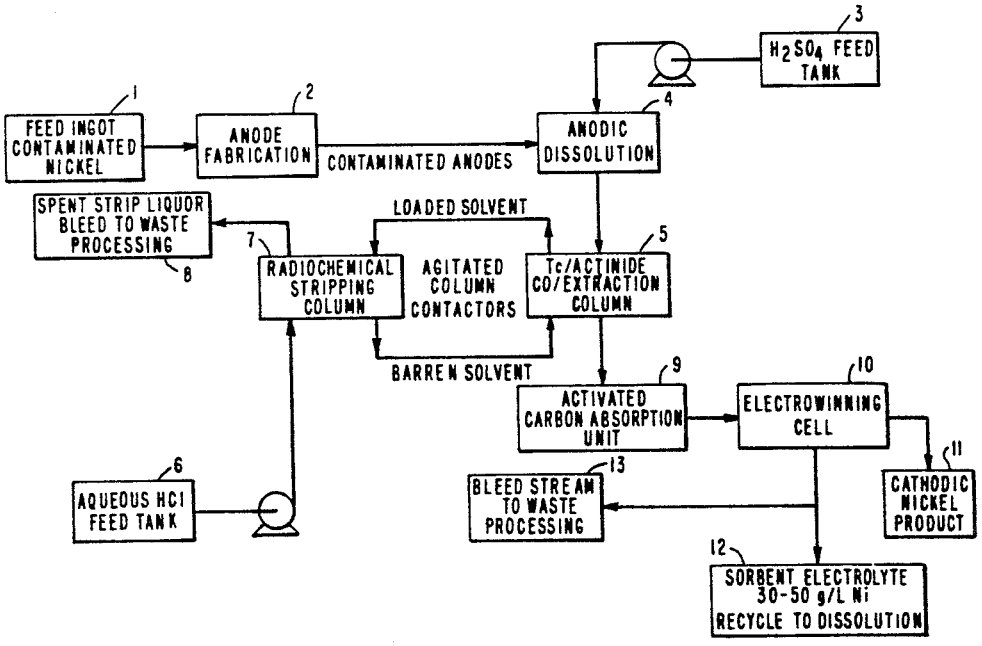

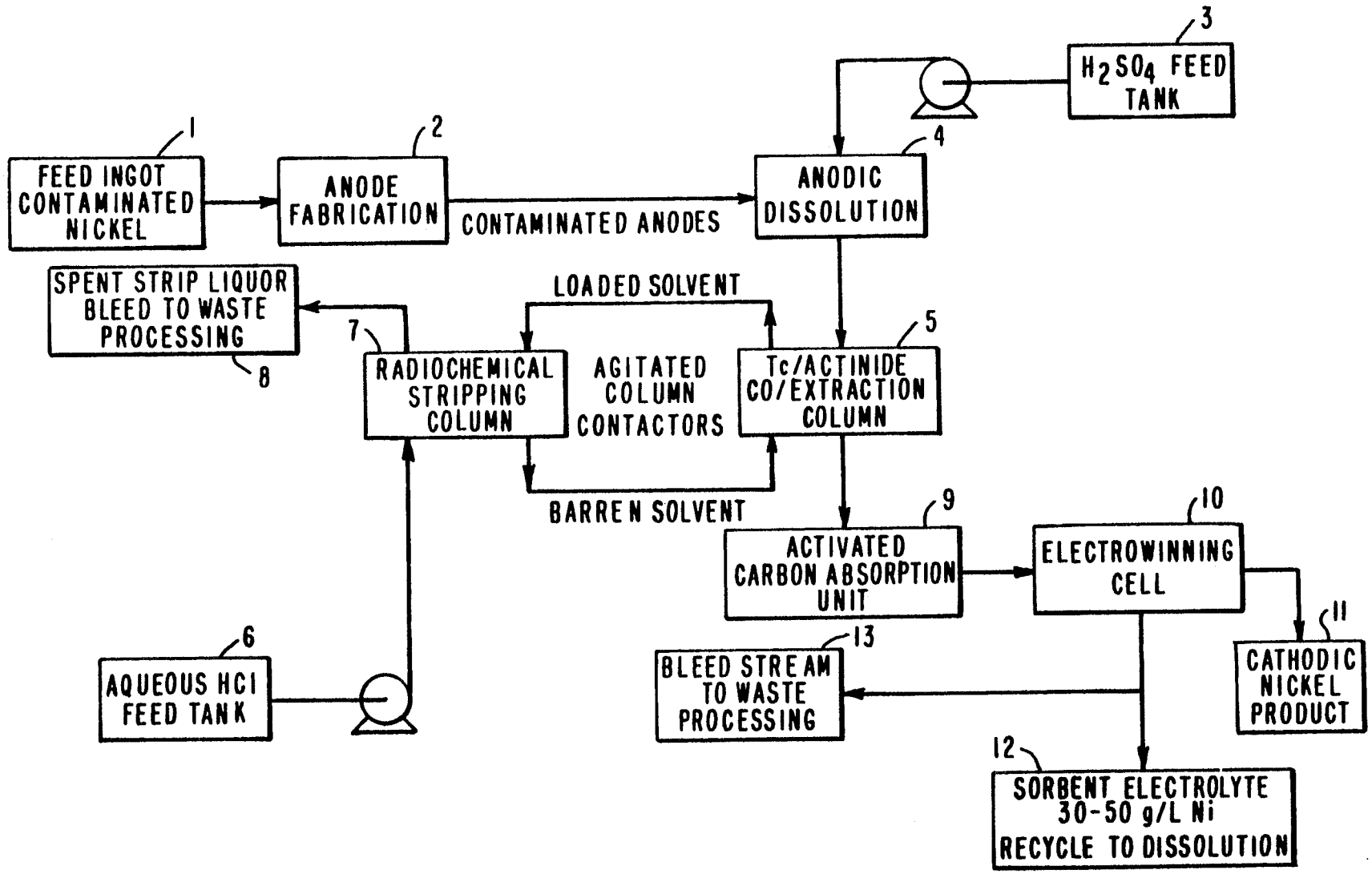
FEED INGOT CONTAMINATED NICKEL
1
ANODE FABRICATION
2
CONTAMINATED ANODES
$H_2SO_4$ FEED TANK
3
ANODIC DISSOLUTION
4
Tc/ACTINIDE CO/EXTRACTION COLUMN
5
LOADED SOLVENT
AGITATED COLUMN CONTACTORS
BARREN SOLVENT
RADIOCHEMICAL STRIPPING COLUMN
7
SPENT STRIP LIQUOR BLEED TO WASTE PROCESSING
8
ACTIVATED CARBON ABSORPTION UNIT
9
ELECTROWINNING CELL
10
CATHODIC NICKEL PRODUCT
11
SORBENT ELECTROLYTE 30-50 g/L Ni RECYCLE TO DISSOLUTION
12
BLEED STREAM TO WASTE PROCESSING
13
AQUEOUS HCl FEED TANK
6

DECONTAMINATION OF RADIOACTIVE METALS

This application is a continuation of application Ser. No. 07/506,044 filed Apr. 9, 1990, now abandoned.

BACKGROUND OF THE INVENTION

1. Field of the Invention

The present invention relates to decontamination of radio-contaminated metals, and in particular to decontamination of radio-contaminated metals either by combined solvent extraction and electrowinning or by oxidative electrorefining. Of particular interest to the present invention is the remediation of radio-contaminated nickel from decommissioning of the DOE-ORO diffusion cascades in which nickel is the primary constituent. However, the decontamination art taught herein applies equally well to the recovery and decontamination of other strategic metals which can be electrowon such as copper, cobalt, chromium and iron.

2. The Prior Art

The sources of radio-contamination in diffusion barrier nickel in particular include uranium with enrichment levels above natural levels, (usually about 0.7%) and reactor fission daughter products, such as Tc, Np, Pu, and any other actinides for example. These fission daughter products are present due to a limited run of reprocessed nuclear fuel through the DOE-ORO diffusion cascades.

Various decontamination processes are known in the art, and specifically for decontamination of nickel. Nickel can be removed by selectively stripping from an acidic solution by electrowinning. See U.S. Pat. No. 3,853,725. Nickel may also be removed by liquid—liquid extraction or solvent extraction. See U.S. Pat. Nos. 4,162,296 and 4,196,076. Further, various phosphate type compounds have be used in the removal of nickel. See U.S. Pat. Nos. 4,162,296; 4,624,703; 4,718,996; 4,528,165 and 4,808,034.

It is known that metallic nickel, contaminated with fission products, could be decontaminated to remove any actinides present by direct electrorefining based on the differences in reduction potential in the electromotive force (emf) series. Actinide removal is favored by two phenomena during electrorefining. Actinides have a significantly higher reduction potential relative to nickel and they are normally won from molten salt electrolyte rather than from aqueous electrolyte. See U.S. Pat. Nos. 3,928,153 and 3,891,741, for example.

In spite of these disclosures, there remains a need for an economical and efficient method to decontaminate metals and more specifically, to separate technetium from these metals in a simple manner.

SUMMARY OF THE INVENTION

The present invention meets the above described needs by either of two modifications to direct electrochemical processing. The first approach combines solvent extraction for technetium removal with electrowinning. In this approach nickel is dissolved in acidic solution (preferably an oxidizing acid bulk as sulfuric or nitric) and oxidized to drive technetium to the heptavalent state, pertechnetate, for solvent extraction. Specifically, mixtures of tri-n-octyl phosphine oxide and di-2-ethyl hexyl phosphoric acid in aliphatic carriers provide co-extraction of actinides and technetium. Use of electrowinning (or a novel electrorefining technique) polishes the decontamination process to produce a radiochemical-free metal product. In the second modification an electrorefining cell rather than electrowinning is used. Here the process favors using a reducing acid such as hydrochloric for the electrolyte. Further reductants such as ferrous, stannous, chromous or other metal reductants, $H_2S$, CO, or hydrogen are added to the cell's anodic chamber to reduce Tc in anolyte solution from the heptavalent to the tetravalent state. The tetravalent technetium is precipitated as $TcO_2$ in the anodic chamber to prohibit technetium transport to the cathode. $TcO_2$ along in the actinides report to the anodic slimes; radio-free nickel is recovered at the cathode. Both processes are particularly useful for the decontamination of nickel.

It is an object of the present invention to provide method of decontaminating radioactive metals.

It is another object of the present invention to provide a method of extracting both technetium and actinides from a radiocontaminated metal, to allow beneficial reuse of the metal.

It is a further object of the present invention to provide a method of incinerating spent solvent during the decontamination process, thus eliminating the production of mixed waste during the decontamination process.

It is yet another object of the present invention to provide a method of decontaminating metal that utilizes electrowinning at a high efficiency while polishing the actinides removal at the same time.

It is an object of the present invention to provide a method of removing cobalt isotopes by including a second extractant circuit which processes the same raffinate with different extractants.

It is another object of the present invention to provide the recycling of the electrolyte to minimize the overall waste generation from the decontamination process.

It is a further object of the present invention to provide a separate method of decontaminating radiocontaminated metal by using electrorefining which eliminates the use of solvents extraneous processing operations beyond the electrolytic cell.

These and other objects of the present invention will be better understood from, the following description of the invention.

BRIEF DESCRIPTION OF THE DRAWING

The figure illustrates a presently preferred embodiment of the first radio-decontamination method of the present invention—namely, solvent extraction of Tc and Co combined in the electrowinning.

DETAILED DESCRIPTION OF THE PREFERRED EMBODIMENTS

As used herein the term metal shall mean any heavy metal including nickel, iron, cobalt, zinc, like transition metals and other metals which can be electrowon. Nickel shall be used as an example for convenience.

DETAILED DESCRIPTION OF THE ELECTROWINNING EMBODIMENT

The present invention uses solvent extraction for technetium removal prior to electrowinning of the basic metal offering significant advantages over competing ion exchange technology for technetium removal. Solvent extraction functions efficiently in the strong acid concentrations produced by the metal dissolution stage;

in such solutions, ion exchange capacity degrades significantly. Solvent extraction extracts both technetium and the actinides; ion exchange will not exhibit similar affinities for all radiochemical solutes likely to be present in the decontamination liquor. Solvent extraction also tolerates suspended solids in solution; ion exchange resins will blind or plug in the presence of suspended solids. Finally, solvent extraction allows for incineration of the spent solvent as a part of the system decommissioning; this is a advantage over using an ion exchange resin in that spent resin incineration requires higher particular combustion temperatures and more complex incinerator designs to prevent fouling of the combustion grate and to provide continued renewal of the resin surface as required for efficient oxidation of the resin.

The present method allows the electrolysis cell to win nickel at a high efficiency while the electrolytic cell functions strictly as a polishing operation to remove the remaining actinides. This minimizes the risk of recontaminating the cathodic nickel product by coreduction of the actinides. Solvent extraction can also remove any cobalt isotopes—not separable from nickel ectrochemically—by including a second extractant circuit processing the same raffinate but using cobalt-selective extractants. Solvent extraction has the added advantage of being immune to interference from plating additives such as boric acid and chloride required for the plating electrolyte. This allows the plating electrolyte to be recycled to the nickel dissolution step as a waste minimization operation rather than being used on a once through basis and being scraped.

While a number of extractants have been demonstrated for technetium for metal recovery, the present invention uses di-2-ethyl hexyl phosphoric acid ($D_2EHPA$) and tri-n-octylphosphine oxide (TOPO). Sulfuric acid (or any other oxidizing acid such as nitric) is used to dissolve the nickel and to load radio-contaminants (Tc and actinides) into the organic solvent during the extraction operation. Oxidizing acids are recommended for dissolution in this embodiment since they maintain both technetium in the heptavalent state and uranium in the hexavalent state, making both of these species amenable to solvent extraction. Concentrated aqueous hydrochloric acid (or other concentrated acid) then strips these radio metals, especially technetium and actinides from the pregnant organic phase.

Referring now to the figure, a contaminated ingot, step 1, is fabricated into electrodes, step 2, and charged into the anodic dissolution tank, step 4, where it is dissolved in sulfuric acid, fed to the tank, step 3, preferably in the range of 0.1 to 4 Normal and most preferably about 2 to 3 Normal. Anodic dissolution is favored over chemical dissolution because it requires shorter residence times and milder conditions to accomplish the dissolution process, but chemical dissolution would work also. Countercurrent extraction with barren solvent, step 5, removes the technetium and actinides from the solution of the base metal. The nominal solvent composition is about (0.1 to 2)M TOPO/(0 to 2)M $D_2EHPA$ dissolved in a long-chained, aliphatic solution; the long-chained aliphatic solvent may include kerosene and/or alkanes. The loaded solvent is preferably stripped, step 7, with a reducing acid about 2 to 6N, aqueous hydrochloric acid solution fed to the stripping column, step 6. The spent strip liquor is bled to waste processing, step 8. The organic-to-aqueous phase contact ratios for the two extraction circuit operations are between 0.25 and 20 for the extraction circuit, and between 0.10 and 10 for the stripping circuit.

The decontaminated raffinate from the extraction circuit passes through a carbon column, step 9, prior to the electrolysis cells, step 10, to remove any residual organic carryover from the extraction. The electrolysis cell operating range preferably includes about a current density of 10 to 300 amps/foot squared with an efficiency of 80 to 98%, pH in the range of 1 to 6, and a cell-operating voltage of 2 to 4 volts per cell. The electrolysis cell is preferably operated at a temperature in the range of 25° to 60° C. The electrolyte additives can include about 0 to 30 g/L free sulfuric acid, up to 60 g/L boric acid and about 20 to 40 g/L chloride ions to improve both the plating rate and the character of the plated deposit. Suitable examples of chloride ion sources which may be used include NaCl, $CaCl_2$ and $NiCl_2$.

A decontaminated nickel cathode, that is capable of beneficial re-use may be recovered from the cell, step 11. The spent electrolyte from the nickel recovery cell is recycled to anodic dissolution, step 12, with a residual nickel concentration of about 30 to 50 grams of nickel per liter potentially combined with plating additives such as the chloride ions and boric acid which may have been added to the electrochemical cell. A bleed stream is also passed to waste processing, step 3.

DETAILED DESCRIPTION OF THE ELECTROREFINING EMBODIMENT

The alternative method of removing metals and particularly nickel substitutes electrorefining for electrowinning and eliminates the solvent extraction operation. This alternative method controls the anolyte oxidation potential to adjust the technetium valence from the heptavalent state to the tetravalent state rather than plating from the heptavalent state obtained naturally during dissolution. Thus, the technetium is oxidized to $TcO_2$ in the anolyte solution to eliminate it from the cathodic product. This alternative eliminates the need for peripheral decontamination processes (such as solvent extraction and/or ion exchange to remove the radio contaminants) and the carbon absorption column to remove any residual organic from the electrolyte (completely) prior to the nickel electrorefining stage. The electrorefining decontamination embodiment allows technetium and other radio contaminants to be removed insitu within the electrorefining cell and also allows cathodic grade, radiochemical-free nickel to be recovered in a single electrorefining step.

Using the standard electrochemical reduction potential series under normal electrorefining cell operating conditions, the nickel half-cell reactions are given by reactions 1 and 2 (referenced to a hydrogen reduction potential of 0 volts):

| | | |
|---|---|---|
| 1) Anode | $Ni - 2e^- \rightarrow Ni(ii)$ | $E = +0.23$ volts |
| 2) Cathode | $Ni(II) + 2e^- \rightarrow Ni_{Metal}$ | $E = -0.23$ volts |

Controlling pH, temperature and anolyte oxidation potential, metallic nickel is won at the cathode.

The apparent half-cell reactions for the electrorefining of metallic technetium are shown in equations 3 and 4. However, neither the reported behavior of technetium in the nickel circuit nor the mode of plating technetium free nickel are obvious from these reactions:

| | |
|---|---|
| 3) $Tc + 4H_2O - 7e^- \rightarrow TcO_4^- + 8H^-$ | $E^\circ = -0.472$ |
| 4) $TcO_4^- + 7e^- + 8H^- \rightarrow Tc + 4H_2O$ | $E^\circ = +0.472$ |

Further, direct experience with this system in the absence of the Tc valence reduction step teaches that technetium will track nickel directly to the cathode. Nickel electrorefining conditions employing a reducing acid (preferably aqueous solutions hydrochloric acid) reduces technetium in the feedstock solution at the anode. Although the complete mechanism of the technetium (VII) reduction and precipitation as $TcO_2$ is not clear, technetium-free nickel is recovered by electrochemical means from radio-contaminated feedstocks.

Equations (5) and (6) potentially describe the half-cell reactions that allow $TcO_2$ precipitation without influencing nickel recovery at the cathode. In a highly concentrated nickel solution (particularly in a chloride electrolyte in which nickel forms no chloride complexes but remains as bare nickel (II)), at least one possible pertechnate-nickel complex can be formed with which is positive:

$$[(TcO_4)^-.XNi^{+2}]^{2x-1}.$$

Not only does this complex provide a positive charge which would be attracted to the cathode but, if x equals 1 or 2, then it would explain why technetium concentrates in the cathodic nickel product relative to the technetium contaminated level in the nickel feedstock. Note also that cationic technetium complexes can form as well.

In a strong oxidizing acid technetium, present either as pertechnate-nickel ion complex or a lower valence, positive technetium complex, migrates from anode to cathode during nickel electrorefining where it is reduced chemically with the cathodic nickel product, and equations 5 and 6 do not occur anodically.

| Anodic Reactions in Reducing Electrolyte | Cathodic Reaction in Reducing Electrolyte |
|---|---|
| (5) $Tc - 7e^- + 4H_2O + TcO_4^- + 8H^-$ | $4e^- + 4H^+ \rightarrow 2H_2$ |
| (6) $TcO_4^- + 4H^+ + 3e^- \rightarrow TcO_2 + 2H_2O$ | |

The complete electrochemical formation of technetium oxide in solution would force insoluble $TcO_2$ to the precipitate in the slimes at the anode by equations 5 and 6, but complete precipitation is unlikely using oxidizing electrolyte conditions because reactions 5 and 6 are difficult to drive to completion in oxidizing media. Further, both the heptavalent technetium state and its pertechnate ion are quite stable in oxidizing the electrolytes. Therefore, a chemical reduction of technetium must boost the strictly electrochemical behavior to drive reactions 5 and 6 to completion.

A reducing acid such as aqueous hydrochloric acid is substituted by the present invention for the oxidizing acid to promote the formation of technetium oxide by anodic reaction shown in equations 5 and 6. Moreover, the oxidation potential of the electrolyte must be controlled to maintain conditions favoring technetium oxide formation. Further, increasing anodic half cell voltages to greater than or equal to $\geqq 0.8$ volts provides an overall cell voltage of greater than equal to 1.2 volts to enhance this reaction.

Chemical reductants can be added to the anodic chamber to enhance technetium valence reduction from VII to IV. The chemical reducing-agents may include hydrazine, hydrazine compounds, hypophosphites, and preferably, metallic chloride such as $SnCl_2$, $FeCl_2$, $CrCl_3$. These materials reduce technetium (VII) to technetium (IV). Carbon monoxide, hydrogen sulfide or hydrogen may be sparged into the solution to drive Tc reduction. The benefit of the gaseous reductants is that they have no residual solution byproducts to co-reduce with nickel at the cathode and chemically contaminate the nickel metal product. Sufficient metallic chlorides capable of reducing technetium are available such that the reducing metal chloride may be selected so that it will be compatible with subsequent alloy applications of the nickel metal.

Whereas particular embodiments of the invention have been described above for purposes of illustration, it will be appreciated by those skilled in the art that numerous variations of the details may be made without departing from the invention as described in the appended claims.

What is claimed is:

1. A method of extracting technetium and actinide radiocontaminants from radiocontaminated nickel comprising the steps:

(a) fabricating a nickel electrode contaminated with technetium and actinides; and then (b) anodically dissolving the electrode contaminated with technetium and actinides in an oxidizing acid electrolyte solution to produce a solution containing actinide ions and at least 30 grams/liter of nickel and to oxidize the technetium to produce pertechnetate anions; and then (c) removing pertechnetate anions and actinides by countercurrent solvent extraction with a barren solution containing TOPO, $D_2EHPA$ or mixtures thereof dissolved in an organic solvent, to produce a decontaminated, nickel containing raffinate, and a contaminated, loaded solvent stream; and then (d) stripping the technetium values from the contaminated, loaded solvent stream with hydrochloric acid;

(e) passing the decontaminated, nickel containing raffinate through an absorbent for organic solvent; and then (f) electrowinning the raffinate in an electrolysis cell with acidic electrolyte to remove residual actinides present, and to recover cathodic nickel.

2. The method of claim 1 using TOPO $D_2EHPA$ or mixtures thereof dissolved in an aliphatic hydrocarbon.

3. The method of claim 1 including providing a second extraction cycle utilizing further extraction of the primary extraction cycle raffinate to extract any cobalt isotopes which may be present.

4. The method of claim 1, where the oxidizing acid is selected from the group consisting of sulfuric acid and nitric acid, and where the pertechnetate anions and actinides removed in step (c) are stripped from the contaminated, loaded solvent stream by hydrochloric acid and incinerated.

5. The method of claim 1, where the barren solution extractant in step (c) contains (0.1 to 2)M TOPO (0 to 2)M $D_2EHPA$ dissolved in kerosine, and where the organic-to-aqueous phase contact ratios for the extraction are between 0.25 and 20.

6. The method of claim 1, where the absorbent used in step (d) removes residual organic before it passes into the electrolysis cell, and is a carbon column, and the electrolysis cell operates at a current density of 10 amp/ft$^2$ to 300 amp/ft$^2$ at a pH range of 1 to 6 for the electrolyte, with electrolyte additives selected from up to 30 g/L free sulfuric acid, up to 60 g/L boric acid and from about 20 g/L to 40 g/L chloride ions.

7. The method of claim 1, where spent acidic electrolyte from step (e) is recycled to step (b) for anodic dissolution.

8. A method of decontaminating radiocontaminated nickel, comprising the steps of:

dissolving nickel contaminated with technetium and actinides in an oxidizing acid electrolyte solution to produce a solution containing at least 30 grams/-liter of nickel ions contaminated with pertechnetate anions and actinide ions;

removing the pertechnetate anions and the actinide ions from the electrolyte solution by solvent extraction with an extractant dissolved in an organic solvent to produce a substantially decontaminated nickel-containing electrolyte solution and a contaminated organic solvent; and electrowinning the nickel from the substantially decontaminated electrolyte solution.

9. The method of claim 8, wherein the oxidizing acid is selected from the group consisting of sulfuric acid and nitric acid.

10. The method of claim 9, wherein the pertechnetate anions and the actinide ions are extracted from the electrolyte solution with an extractant selected from the group consisting of TOPO, D2EHPA and mixtures thereof.

11. The method of claim 9, wherein the recycled electrolyte solution contains boric acid in amount of less than about 60 g/l.

12. The method of claim 9, wherein the recycled electrolyte solution contains from about 20 to about 40 g/l chloride ions.

13. The method of claim 9, wherein the recycled electrolyte solution contains from about 30 to about 50 g/l nickel.

14. The method of claim 13, wherein the recycled electrolyte solution contains a plating agent selected from the group consisting of boric acid, chloride ions and mixtures thereof.

15. A method of decontaminating radiocontaminated nickel, comprising the steps of:

dissolving nickel contaminated with technetium and actinides in an oxidizing acid electrolyte solution to produce a solution containing at least 30 gm/liter or nickel ions contaminated with pertechnetate anions and actinide ions;

removing the pertechnetate anions and the actinide ions from the electrolyte solution; and electrowinning the nickel from the decontaminated electrolyte solution.

16. The method of claim 15, wherein the oxidizing acid is selected from the group consisting of sulfuric acid and nitric acid.

17. The method of claim 15, wherein the solution is a sulfuric acid solution.

* * * * *